US011918167B2

(12) United States Patent
Chojnacki et al.

(10) Patent No.: US 11,918,167 B2
(45) Date of Patent: Mar. 5, 2024

(54) DISHWASHER CHOPSTICK TRAY

(71) Applicant: WHIRLPOOL CORPORATION, Benton Harbor, MI (US)

(72) Inventors: Damian M. Chojnacki, Wroclaw (PL); Mark S. Feddema, Kalamazoo, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/498,331

(22) Filed: Oct. 11, 2021

(65) Prior Publication Data

US 2022/0133125 A1 May 5, 2022

(30) Foreign Application Priority Data

Oct. 13, 2020 (CN) ..... 202011092046.2

(51) Int. Cl.
*A47L 15/50* (2006.01)
*A47L 15/42* (2006.01)

(52) U.S. Cl.
CPC ..... *A47L 15/507* (2013.01); *A47L 15/4246* (2013.01); *A47L 15/502* (2013.01); *A47L 15/504* (2013.01)

(58) Field of Classification Search
CPC .... A47L 15/502; A47L 15/504; A47L 15/505; A47L 15/507; A47L 15/4246
See application file for complete search history.

(56) References Cited

U.S. PATENT DOCUMENTS

| | | | | |
|---|---|---|---|---|
| 2,739,025 | A * | 3/1956 | Stoddard | A47L 15/507 312/301 |
| 2,745,707 | A * | 5/1956 | Sebens | A47L 15/507 312/301 |
| 3,837,917 | A * | 9/1974 | Jenkins | A47L 15/505 134/155 |
| 3,861,769 | A * | 1/1975 | Jenkins | A47B 88/40 312/334.4 |
| 5,462,348 | A | 10/1995 | Ellingson et al. | |
| 9,161,677 | B2 | 10/2015 | Hofpeter et al. | |
| 9,414,737 | B2 | 8/2016 | Paschini et al. | |
| 2003/0226580 | A1* | 12/2003 | Welch | A47L 15/504 134/201 |

(Continued)

FOREIGN PATENT DOCUMENTS

| | | | |
|---|---|---|---|
| CN | 104739353 | A | 7/2015 |
| CN | 109700403 | A | 5/2019 |

(Continued)

*Primary Examiner* — Joseph L. Perrin
*Assistant Examiner* — Irina Graf
(74) *Attorney, Agent, or Firm* — Brooks Kushman, P.C.

(57) ABSTRACT

An automatic dishwashing device may include a tub defining a hollow dishwashing cavity having a back, top, bottom, and two sides and is accessible via an access opening at a front of the cavity, a rack slidably disposed within the tub and moveable in a longitudinal direction between a stored position within the tub to an extended position where the rack extends outside of the tub, and a tray slidably engaged with the rack for sliding movement in the longitudinal direction, wherein the tray is configured to selectively remain partially within the tub when the rack is in the extended position or extend outside the tub when the rack is in the extended position.

12 Claims, 6 Drawing Sheets

(56) References Cited

U.S. PATENT DOCUMENTS

2013/0002107 A1* 1/2013 Paschini ..... A47L 15/502
312/228.1

FOREIGN PATENT DOCUMENTS

| | | | |
|---|---|---|---|
| CN | 110870754 | A | 3/2020 |
| CN | 211213007 | U | 8/2020 |
| DE | 102013103707 | A1 | 10/2014 |
| EP | 1072221 | A1 | 1/2001 |
| EP | 3089648 | B1 | 7/2018 |
| WO | 2015101877 | A1 | 7/2015 |
| WO | 2017194507 | A1 | 11/2017 |

* cited by examiner

DISHWASHER CHOPSTICK TRAY

CROSS-REFERENCE TO RELATED APPLICATIONS

This application claims priority to Chinese Patent Application No. CN 202011092046.2 filed Oct. 13, 2020, the disclosure of which is hereby incorporated in its entirety by reference herein.

TECHNICAL FIELD

Disclosed herein are dishwasher rack and tray assemblies.

BACKGROUND

Dishwashers have been and are becoming more and more standard in homes. Dishwashers may provide for automatic washing of dishes arranged on various racks within the dishwasher. These racks may be movable from the interior of the dishwasher cabin so as to be accessible to the user for loading and unloading. Efficiency both in space saving, as well as loading capabilities, is an important feature for personal use dishwashers.

SUMMARY

An automatic dishwashing device may include a tub defining a hollow dishwashing cavity having a back, top, bottom, and two sides and is accessible via an access opening at a front of the cavity, a rack slidably disposed within the tub and moveable in a longitudinal direction between a stored position within the tub to an extended position where the rack extends outside of the tub, and a tray slidably engaged with the rack for sliding movement in the longitudinal direction, wherein the tray is configured to selectively remain partially within the tub when the rack is in the extended position or extend outside the tub when the rack is in the extended position.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is an automatic dishwasher assembly having a slidable tray attached to a rack for receiving dishes or other kitchen equipment for automatic washing. The slidable tray may be arranged above and slidable along the rack, both in an extended position and well as in a stored position within the dishwasher. The slidable tray may be configured to cover at least a portion of the rack when the rack is extended to allow the tray to be loaded and unloaded. Additionally, the slidable tray may be configured to be retained within the dishwasher while the rack is extended to allow for the rack to be loaded and unloaded without the slidable tray creating an obstruction. The slidable tray may also be slidably extendable from the dishwasher, independently from the rack, to allow for loading and unloading of the slidable tray without extension of the rack out of the dishwasher.

To facilitate the positioning, the slidable tray may be slidably arranged on a mechanism attached to the rack. For instance, the slidable tray may be arranged on a pair of parallel rods extending upward from the rack and extending longitudinally from the front to the back on each side of the rack. The slidable tray may define a utensil area with a lip on each side of the utensil area. An engagement mechanism is located outboard of the side lips and is configured to engage with the respective rod to maintain the slidable relationship therewith so to allow the tray to slide longitudinally along the rods. The utensil area of the tray may define a plurality of carefully positioned projections or areas configured to receive various dining utensils such as knives, chopsticks, etc., that may be difficult to store within a rack or a conventional silverware tray or basket directly. Through use of the slidable tray, difficult-to-load items may be washed during a cleaning cycle, without reducing the rack space available for other kitchen equipment and without blocking access to the rack below.

Figure 1:
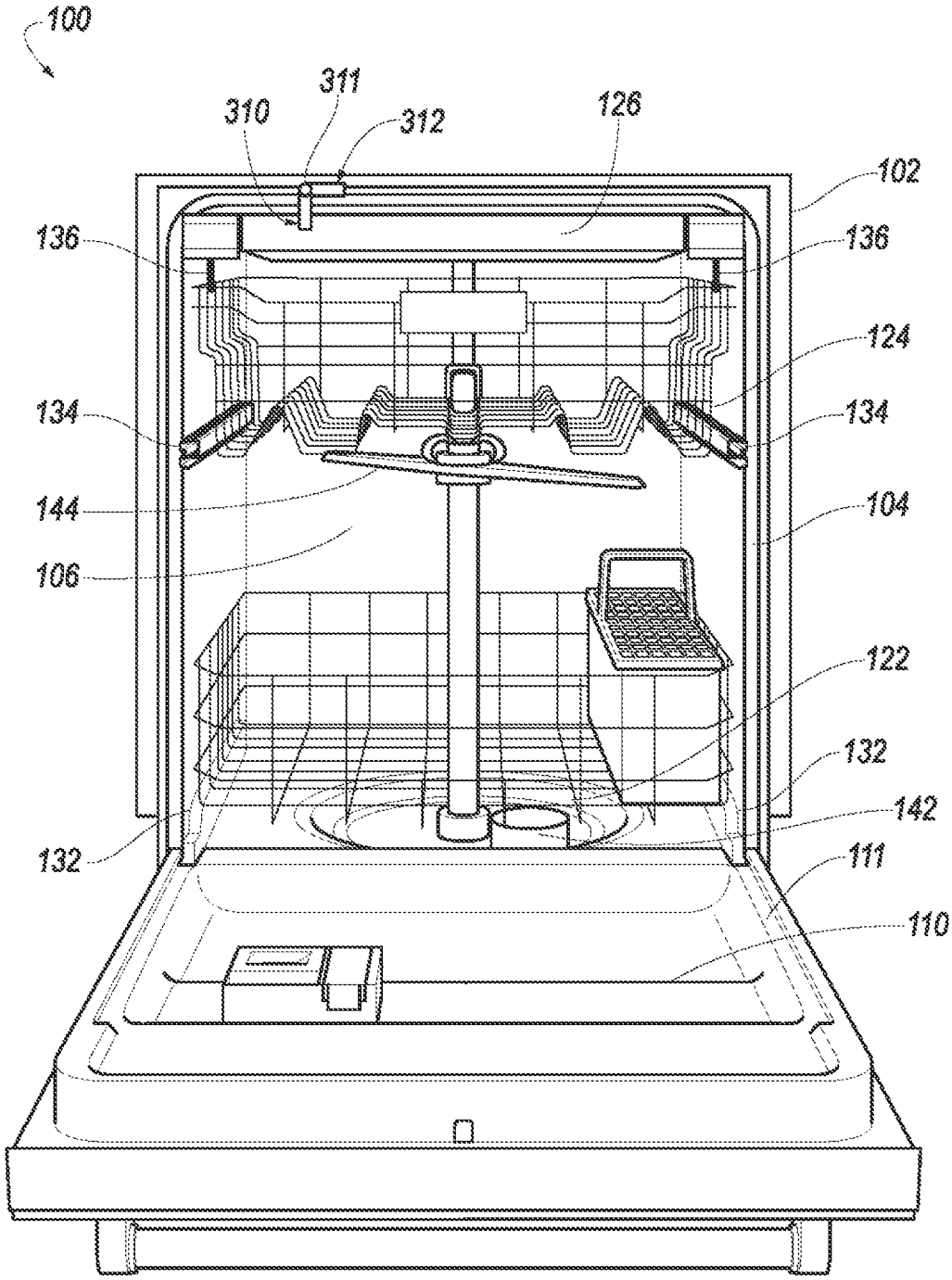
FIG. 1 illustrates an example front perspective view of a dishwasher in accordance with one example embodiment.

FIG. 1 illustrates an example front perspective view of a dishwasher 100 in accordance with one example embodiment. The dishwasher 100 may be an automated appliance configured to clean kitchen equipment placed within the dishwasher 100. The kitchen equipment may include tableware such as dishes, glassware, cutlery and other utensils, and well as food preparation equipment such as pots and pans, slicers, presses, and peelers. To perform the cleaning, the kitchen equipment is placed on racks 122, 124 inside a tub 104 of the dishwasher 100. A door assembly 110 is closed to form a watertight seal around the tub 104. Washing liquid and rinsing liquid is propelled from jets onto the kitchen equipment to clean dirt, grease, and other contaminants off the kitchen equipment. Though the examples described herein are generally related to in-home and personal use dishwashers, the same concepts may be applicable to commercial dishwashers as well.

The dishwasher 100 may include a frame 102 defining the exterior of the dishwasher 100. The frame 102 may be configured to interface with components exterior to the dishwasher 100 for installation, such as cabinets, countertops, floors, etc. The frame 102 may include a top, left side, right side, back, and bottom.

The tub 104 may define a hollow cavity or interior of the dishwasher for washing dishes. The tub 104 may define an open-face, or access opening 106 with walls at the top, left side, right side, back and bottom. A chassis (not individually labeled) may be arranged between the frame 102 and the tub 104 to maintain the tub 104 within the frame. The chassis may support the tub 104 and allow for maintaining space between the frame 102 and the tub 104.

A door assembly 110 may be arranged at a front of the dishwasher 100. The door assembly 110 may be attached to the dishwasher at the bottom front edge of the frame 102 and may be hinged thereat to move between open and closed positions. In the closed position, the door assembly 110 may seal the tub 104 at the access opening 106. In the open position, the cavity may be accessible via the access opening. In another example, the door assembly 110 may operate as a drawer that can be slidably extended outward from the front of the dishwasher 100 to move into the open position, and slidably retracted back into the dishwasher 100 to the closed position to seal the tub 104.

The tub 104 may house at least one dish rack. In the example shown in FIG. 1, the dishwasher 100 includes a first dish rack 122 and a second dish rack 124. It should be noted that while two disk racks are shown, this is only one example, and dishwashers 100 with more or fewer dish racks are possible. For instance, a dishwasher 100 may include a single rack or three or more racks.

Regardless of quantity or arrangement, the dish racks 122, 124 may be designed to hold the kitchen equipment in place for cleaning by the dishwasher 100. In many examples the dish racks 122, 124 are wire frame racks that allow for the flow of liquid within the tub 104. Although racks 122, 124 made of plastic, other materials are possible. The dish racks 122, 124 may generally include tines or other projections to allow the kitchen equipment to be washed to be held in a spaced apart relationship, such that the washing liquid and rinsing liquid can be projected onto the exposed kitchen equipment surfaces for cleaning these surfaces.

The racks are generally adapted to move between a retracted wash position within the tub 104 and an extended position outside the tub 104 for loading and unloading of the kitchen equipment to be washed. The racks typically include wheels or rollers for rolling movement along tracks or guides to the retracted and extended positions. In the illustrated example, the first rack 122 includes rollers or wheels that cooperate with a first track 132 formed at the bottom wall of the tub 104. A door track 111 may be arranged on the dishwasher door 110 as shown to allow the first rack to be rolled into an extended position when the door 110 is open. The second rack 124 is generally mounted within the tub 104 along a pair of second support rails 134 that cooperate with rollers associated with the side walls of the tub 104. Alternatively, the second rack 124 may be connected to a telescoping rail that allows the second rack to be extended out of the tub area when the door 110 is open. Thus, as shown the first and second racks 122, 124 may be movable along their respective track rails 132, 134 to allow the respective racks 122, 124 to be slidable in and out of the access opening 106.

The dishwasher 100 may also include a spray system for spraying liquid within the tub 104 during a cleaning cycle. In an example cycle, washing liquid including soap may first be sprayed onto the kitchen equipment, and then once washed, rinsing liquid without soap may then be sprayed onto the kitchen equipment. The spray system may include various jets for providing the liquid onto the surfaces of dishes during the automated washing and rinsing operations. The spray system may include a bottom sprayer 142, middle sprayer 144, and a top sprayer (not shown). In some examples, one or more of the sprayers are positioned at fixed locations within the tub 104. In other examples, one or more of the sprayers may be rotating spray arms with various nozzles configured to spray water onto the dishes maintained on the rack for cleaning. For instance, water jets on the spray arm may be angled so the water sprays out of the spray arms at an angle (e.g., ~45 degrees off the vertical) thereby causing the spray arms to rotate due to the pressure of the exiting water.

During loading, a user may open the door assembly 110 into the open position, pull the racks 122, 124 from the tub 104, and load the kitchen equipment onto the racks 122, 124. Once completed, the user may push the racks back into the tub 104, move the door assembly 110 back to the closed position, and initiate the cleaning cycle. Once the cleaning cycle has been completed, the user may again open the door assembly 110 to remove the cleaned kitchen equipment from the racks.

Some dishwashers 100 include additional racks (such as three racks instead of two), to allow for the cleaning of more kitchen equipment per run of the dishwasher 100. Yet, each additional rack and track or rail mechanism adds significant cost and manufacturing effort to the dishwasher 100. Also, some kitchen equipment, such as chopsticks, knives, or straws may be difficult to load into the racks due to their dimensions. These items are sometimes placed into removable trays or baskets that fit into or on top of the racks. Still, trays that fit into the racks reduce the space available for other kitchen equipment, and trays that fit on top of the rack block access to the rack below.

A tray 126 may be arranged on and above one or more of the racks 122, 124. In the illustrated example, the tray 126 is arranged above the second rack 124, but other configurations are possible, such as a single rack with a tray 126, or multiple racks each with a tray 126, or one rack with multiple trays. As with the dish racks 122, 124, the tray 126 is configured to receive kitchen equipment for washing. In one non-limiting example, the tray 126 may be designed to hold kitchen equipment such as chopsticks or knives that, due to their dimensions, are more difficult to hold in a fixed spaced apart arrangement within the dish racks 122, 124 themselves.

In the illustrated example, the tray 126 is arranged above the second rack 124 and maintained by tray supports 136 extending from the second rack 124. As the tray 126 is attached to the second rack 124, the tray 126 may be moveable along with the second rack 124 as the second rack 124 is moved between the retracted and extended positions. The tray 126 may also be slidable along the tray supports 136 so it can be repositioned or maintained in position independent of movement of the second rack 124. For instance, this may allow the tray 126 to be maintained within the tub 104 while the second rack 124 is extended. This is described in further detail below.

Figure 2:
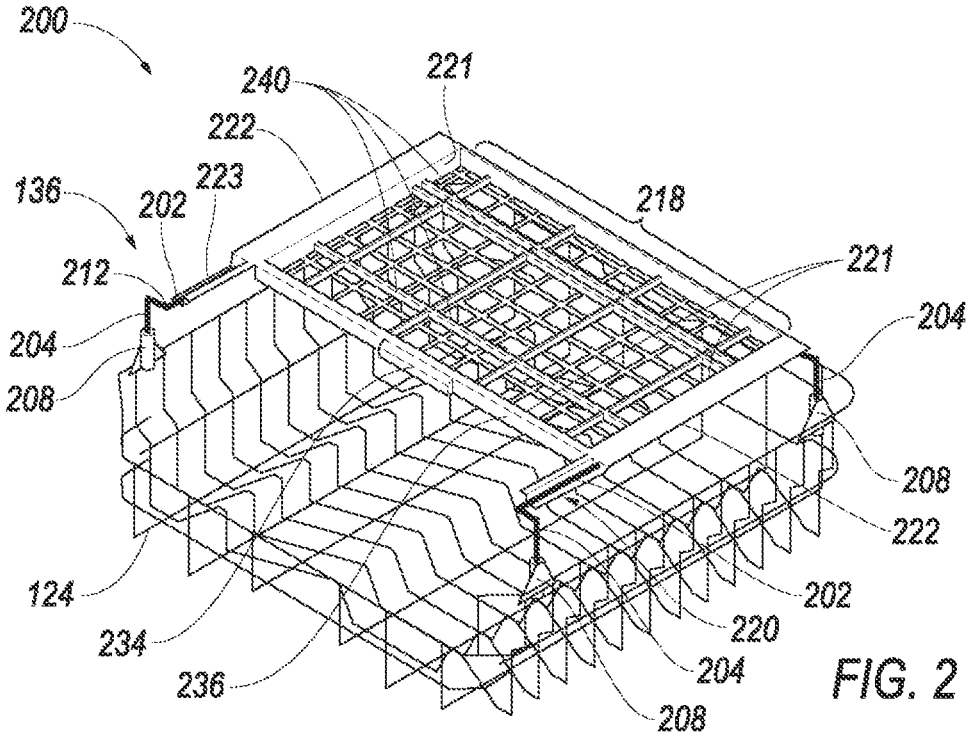
FIG. 2 illustrates an example perspective view of a rack assembly of the dishwasher of FIG. 1 in a congruent state.
Figure 3:
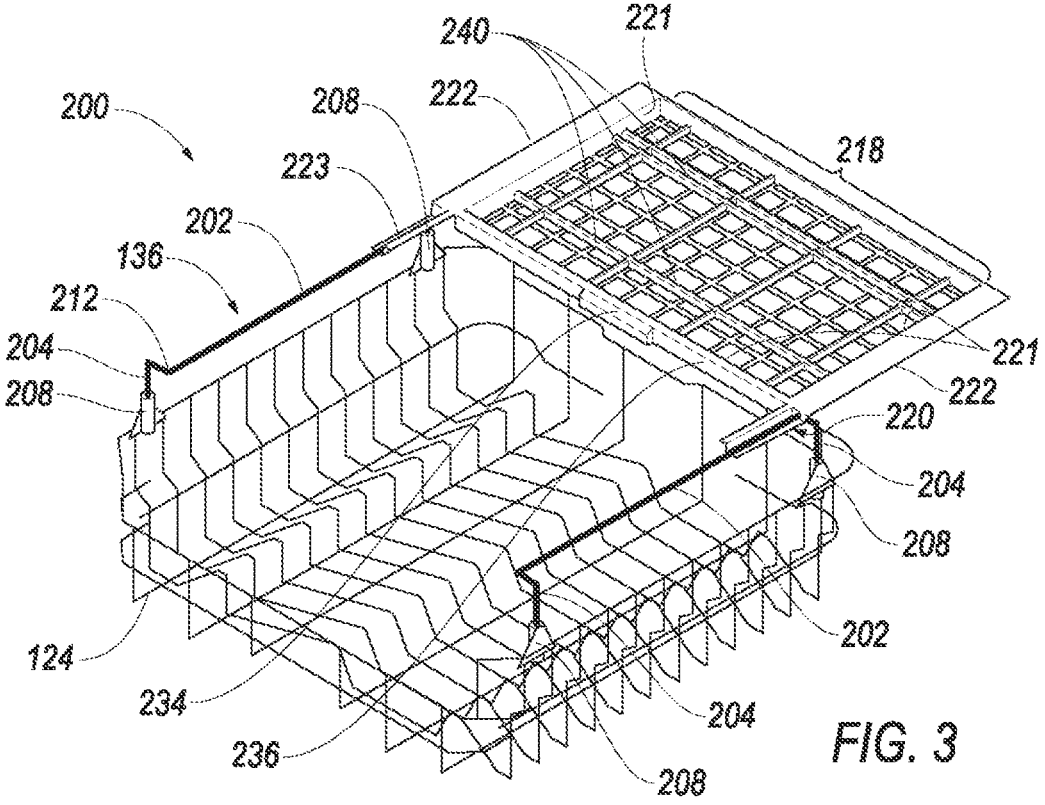
FIG. 3 illustrates an example perspective view of a rack in a non-congruent state.

FIG. 2 illustrates an example perspective view of a rack assembly 200 including the second rack 124 and the tray 126 with the tray 126 being in a congruent state with the second rack 124. The congruent state indicates that the tray 126 is arranged above the second rack 124, as shown in FIG. 2. The rack assembly 200 may be in a congruent state both when the second rack 124 is stored within the tub 104, as well as when the second rack 124 is extended through the access opening 106 from the tub 104. FIG. 3, on the other hand, illustrates an example perspective view of a rack assembly 200 including the second rack 124 and the tray 126 with the tray 126 being in a non-congruent state with the second rack 124. In this example, the tray 126 may remain inside the tub 104 while the second rack 124 is extended.

The tray 126 may be extendable via the tray support 136. The tray support 136 may include a pair of wires, one arranged on each side of the second rack 124, but any other type of support can be employed. The tray supports 136 may include a horizontal portion or horizontal rod 202 supported by a pair of vertical structures or vertical rods 204, one at each longitudinal end of the second rack 124. The horizontal rods 202 may be opposite and parallel to one another. The vertical rods 204 may each be attached to the second rack 124 via a clasp 208, such a bracket, or may be integrally formed with the second rack 124. The clasp 208 may be formed of a plastic or metal material and maintain the vertical rod 204 perpendicular to the second rack 124. The vertical rod 204 and the horizontal rod 202 may be formed of a single piece of metal and may form a bend 212 therebetween.

The tray 126 may be configured to be maintained above the rack 124 during washing. The tray 126 may be of a rectangular shape and may include a utensil area 218 configured to hold utensils during operation of the dishwasher 100. Lips 221 may be arranged on either said of the utensil area 218 and provide borders to the utensil area 218. The utensil area 218 may include various rows and projections 240 configured to hold utensils such as chopsticks, knives, silverware, etc. As shown in FIG. 2, two rows of projections 240 are provided that extend side-to-side across the tub 104 and four rows of projections 240 are provided perpendicular thereto. The distances between the projections 240 are not equal to provide a structure to hold many different types of utensils. For example, chopsticks may be best positioned on the two rows of projections 240 that run side-to-side in the tray 126, whereas a knife may be best positioned across three rows of projections 240 that run front-to-back in the tray 126. Each row of projections 240 is intentionally set at a different distance from others rows to provide added versatility.

The tray 126 also may include one or more engagement area 222 disposed vertically above tray support 136. The engagement areas 222 include a guide recess 220 extending along the sides of the utensil area 218.

The guide recess 220 is adapted to receive the tray support 136 and specifically in this example a portion of the horizontal rod 202 in a sliding engagement. The guide recess 220 may be in indentation or may more substantially surround the horizontal rod 202. The guide recess 220 may allow the tray 126 to slide along the horizontal rod 202 while maintaining the tray 126 thereon. Alternatively, the guide recess 220 may be employed with a friction fit to only allow sliding when a certain force threshold is achieved. In addition to a side of the utensil area 218, engagement area extenders 223 are provided. The extenders 223 project from the utensil area 218 in the front direction. The extenders 223 may include an extension of the guide recess 220 at each side of the utensil area 218. The lips 221 may also be configured as the engagement area 222 or to overlap, or cover, a portion of the guide recess 220 and horizontal rod 202 when in the congruent position.

The tray 126 may be manually moved along the horizontal rod 202. To facilitate this manual operation, the tray 126 may include a handle 234 arranged at the front side 236 of the tray. The handle 234 may be arranged at the center of the front side 236 as shown in FIGS. 3 and 4, though may be arranged left or right of the center along the front side 236 (or as a pair of handles 134 at each of the left and right). The handle 234 may be made of the same material as the tray 126 and may provide a smooth and comfortable surface for a user to grip onto. Additionally or alternatively, the handle 234 may be coated with a smooth material such as polyurethane, foam, silicone, rubber, etc.

As explained above, the tray 126 may be arranged on the pair of horizontal rods 202 extending from the rack 124. Thus, the tray 126 is maintained by a simple, wire-like assembly instead of being supported by a full separate guide rail or track mechanism on the tub 104. This allows for significant cost savings both due to the decrease in raw materials that would be required to assemble another pair of guide rails, as well as costs associated with assembly time. Furthermore, usability is increased due to the ability to retain the tray 126 within the rub while the rack 124 is extended. The tray 126 may be out of sight and out of mind for the user while the user loads and unloads the rack and until the user desires the tray to store utensils such as knives and chopsticks. Further, the handle and slidability of the tray from back to front and from front to back creates a similar and familiar experience, similar to that of traditional dish racks.

Figure 4B:
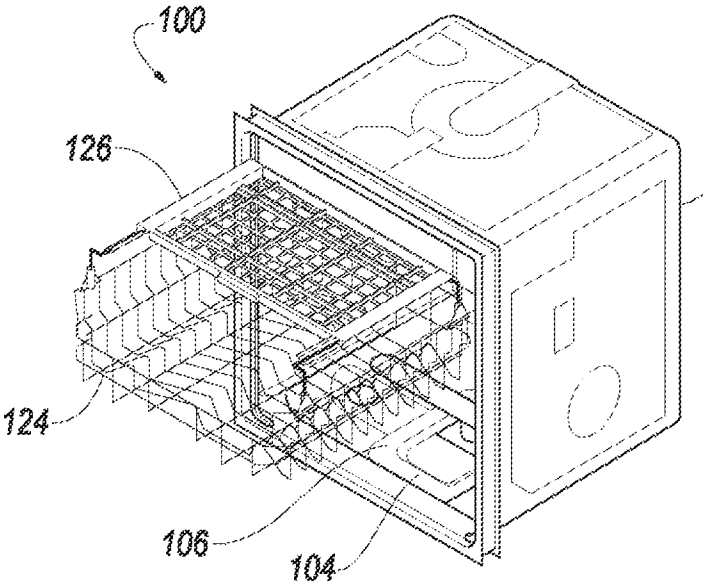
FIG. 4B illustrates the example rack assembly in a congruent extended state.
Figure 4A:
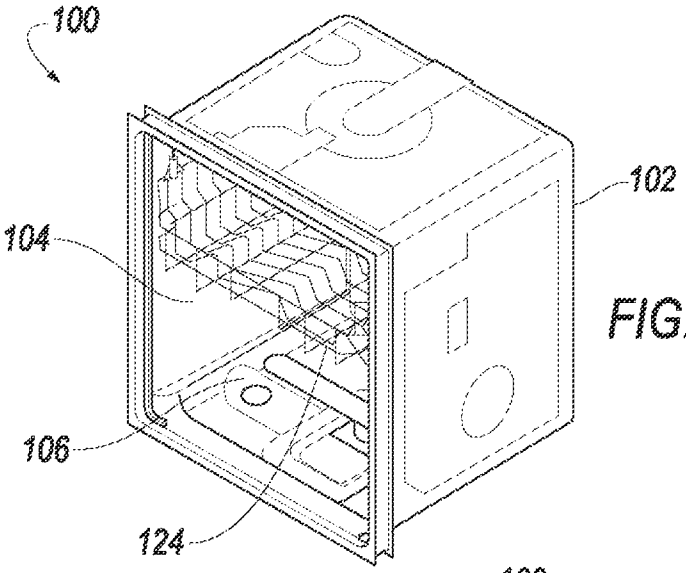
FIG. 4A illustrates the example rack assembly in a congruent stored state.
Figure 4C:
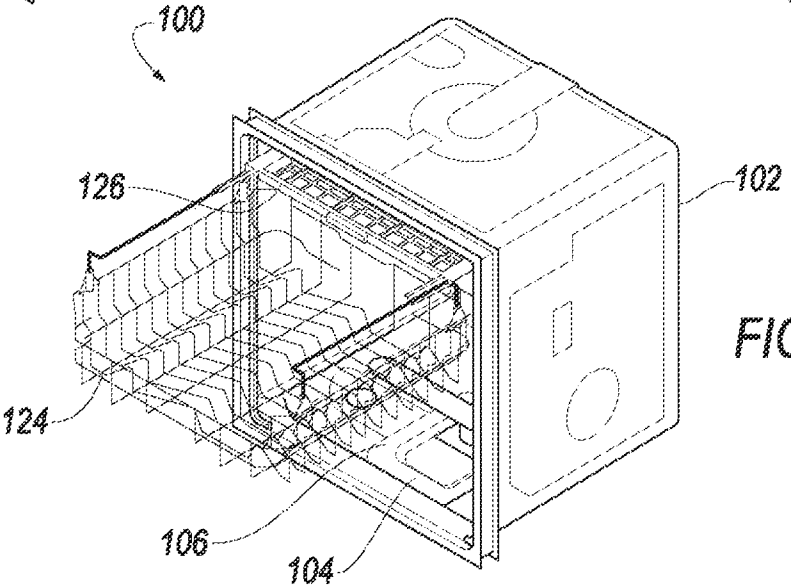
FIG. 4C illustrates the example rack assembly in a non-congruent state.

FIGS. 4A-C illustrated various use examples for the rack assembly 200. FIG. 4A illustrates the example rack assembly 200 in the congruent stored or dishwasher operation state. In this example, both the rack 124 and tray 126 are stored within the tub 104.

FIG. 4B illustrates the example rack assembly 200 in a congruent extended state. In this example, both the rack 124 and tray 126 are extended through the access opening 106 from the tub 104.

FIG. 4C illustrates the example rack assembly 200 in a non-congruent state. In this example, the rack 124 is extended through the access opening 106, while the tray 126 is at least partially retained within the tub 104 and limits obstruction to the rack 124. In this example, the rack 124 may be more accessible for loading with the tray being out of the way.

As explained above, the tray 126 may include engagement area extenders 223 that project away from the utensil area 218 and may be configured to rest on or underneath the horizontal rod 202. As with the engagement area 222, the engagement extenders 223 include the guide recesses 220 that cooperate with the rod 202 in a sliding relationship. The engagement extenders 223 may be employed to retain engagement with the tray 126 while the tray avoids obstructing access to rack 124 as shown in FIG. 4C. The guide recesses 220 and associated engagement extenders 223 may be movable across the horizontal rod 202 so that the tray 126 may move longitudinally with respect to the second rack 124. Referring to FIG. 4C, as well as FIG. 3, in the extended non-congruent state, a portion of the engagement area 222 may form a stop 232 with the bend 212 of the tray support 136, preventing the second rack 124 from extending completely past the tray 126. That is, the tray 126 may remain attached to and supported by the horizontal rod 202, even in the non-congruent state.

Referring back to FIGS. 2 and 3, in the illustrated examples, the tray 126 may be longitudinally shorter (in the front to back direction) than the rack 124. Thus, in the congruent state, the tray 126 may partially cover the rack 124, allowing a portion of the rack 124 to be exposed for loading, but vertically oriented over the remaining portion of the rack 124 arranged below the tray 126. During use, the user may wish to gain access to the tray 126, as well as the rack 124 and may move the tray 126 between the congruent and non-congruent positions accordingly, or between different locations in the congruent position.

The tray 126 may default to being in the stored position. That is, the tray 126 may remain within the tub 104 when the rack 124 is pulled through the access opening 120 by the user, as shown in FIG. 4C. Referring once again to FIG. 1, as an example, the tub may include a lever 162 configured to pivot about a pivot pin 311. The lever 310 may be disclosed in a recess 312 located in the tub 104. The lever 310 may selectively fix the tray 126 to the second rack 124. In the un-locked position, the tray 126 does not slide with respect to rack 124 when the rack is extended outside of the tub 104 and may be configured to be non-congruent with the second rack 124. Alternatively, the lever 310 may be pivoted to an un-lock position. In this position, the lever 310 may disengage the tray 126, and allow the tray 126 to move with the second rack 124 when the rack 124 is slid outside of the tub 104.

Alternatively, the tray 126 may be retained within the tub 104 via a friction retention mechanism. The retention mechanism may be a block arranged within the tub 104 and configured to create friction between the block and the lips 221 of the tray 126.

Upon desired access to the tray 126, the user may, via the handle, apply a pull-force to the tray 126 to disengage the friction hold between the block and the engagement area 222. The tray 126 may thus be extended into the extended state, similar to the example shown in FIG. 4B.

Additionally or alternatively, the guide recess 220 may be held in place on the tray support 136 via a friction fit, therefore allowing the tray to move with the rack 124 when no additional force is applied to the tray that can overcome the friction fit. Therefore, when in the congruent position while in the tub, the tray 126 will remain in the congruent position when the rack 124 is slid longitudinally out of the tub. A user may push the tray 126 to a non-congruent position within the tub while also holding the rack 124 by using a force above the threshold of the friction fit. If in the non-congruent position and the rack 124 is returned to the tub 104, the back of the tub 104 may apply a force to the tray 126 to overcome the friction fit and return the tray 105 to the congruent position as the rack 124 is slid back within the tub 104.

Figure 5:
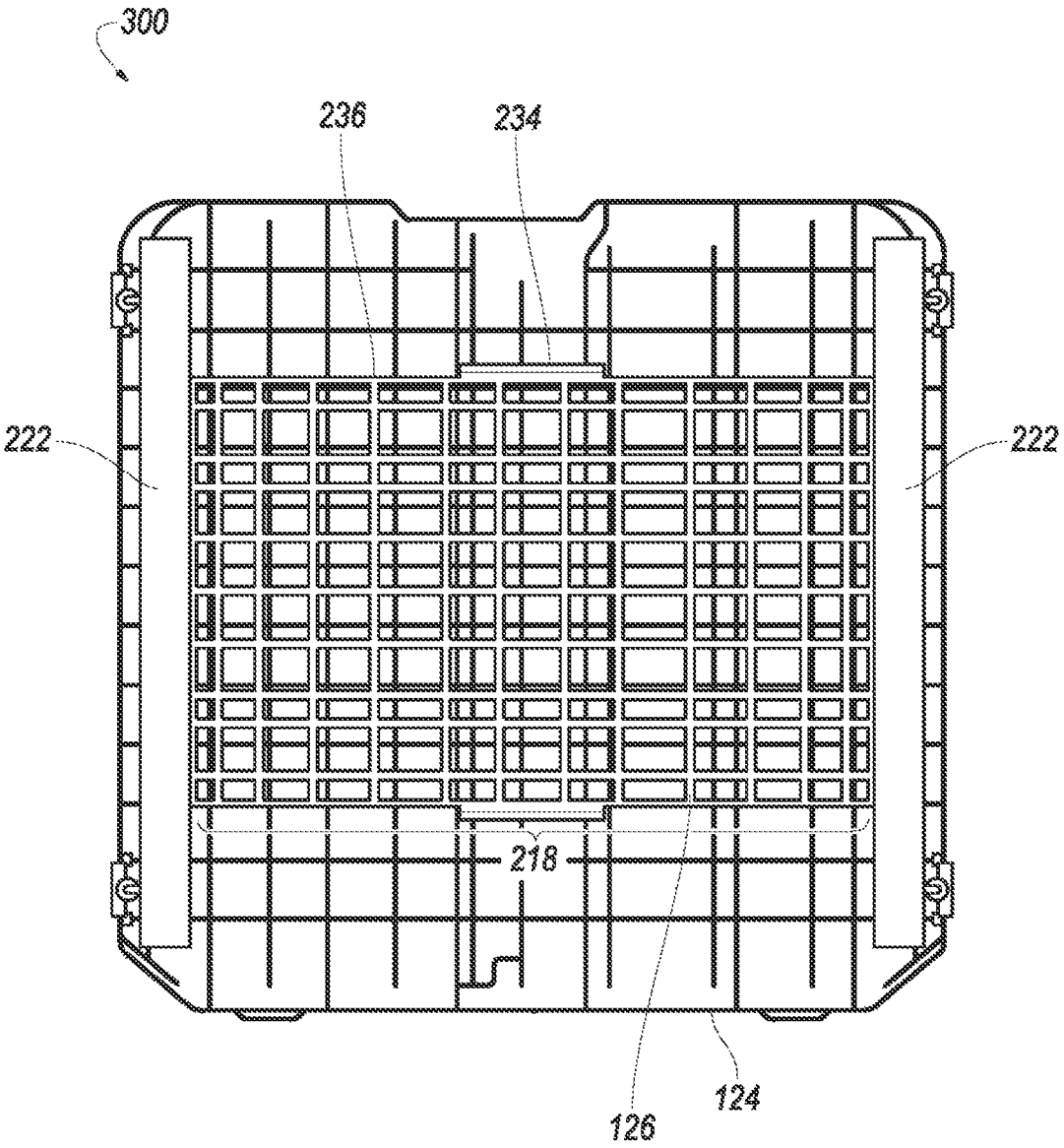
FIG. 5 illustrates an example perspective view of another example rack assembly.

FIG. 5 illustrates a top view of another example rack assembly 300. In this example, the tray 126 may include engagement area extenders 223 (not visible in FIG. 5) on both the front and back sides of the utensil area. The use of multiple engagement extenders 223 allows not only for the non-congruent position to be achieved with the tray 126 aft of the rack 124 as shown in FIG. 3, but it also allows for a non-congruent position to be achieved with the tray 126 forward of the rack 124. This example may permit the tray 126 to extend outside of the tub while the rack 124 is still positioned within the tub.

Figure 6:
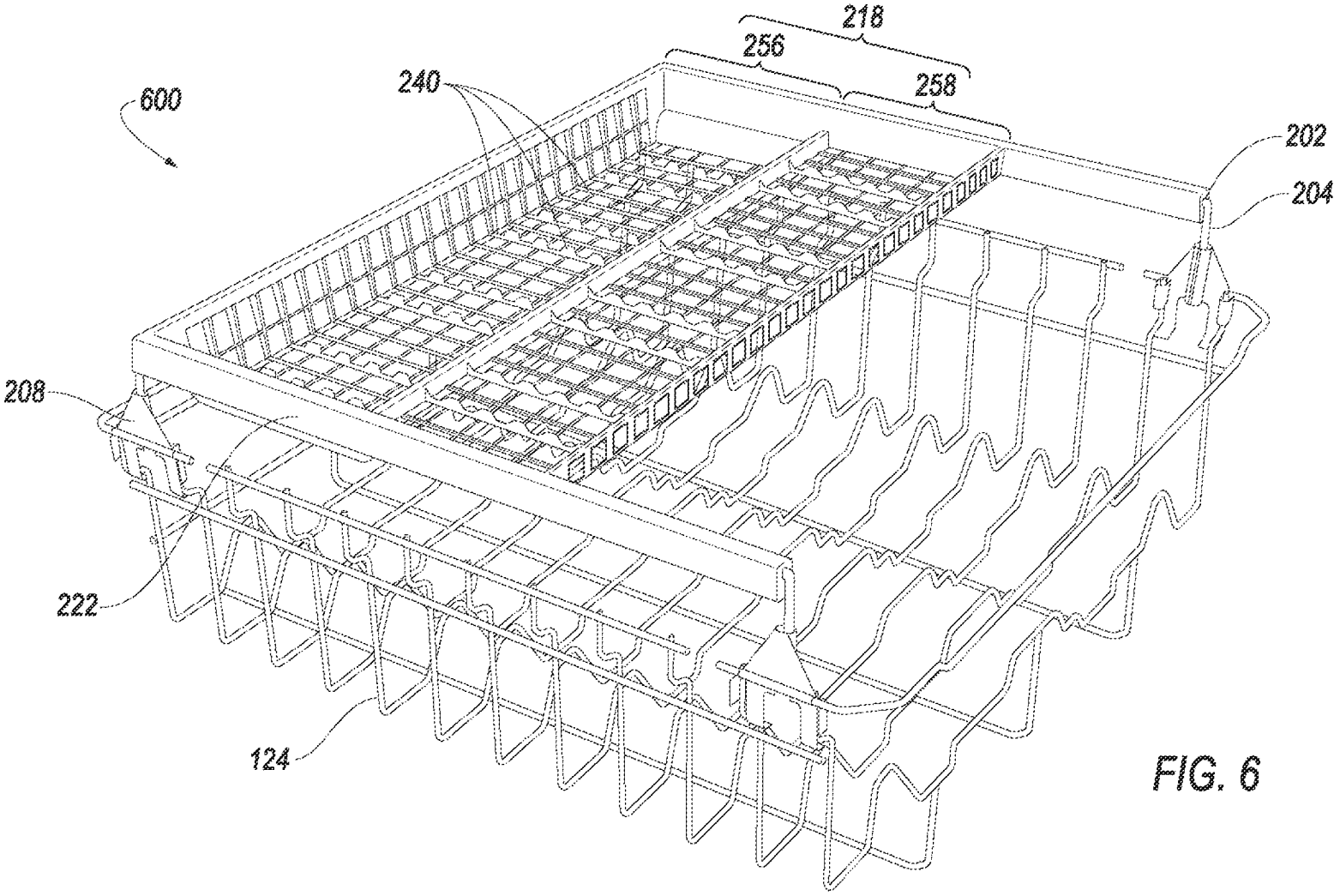
FIG. 6 illustrates a perspective view of another example rack assembly.

FIG. 6 illustrates a perspective view of another example rack assembly 600. In this example, the tray 126 may include the utensil portion 218 being made up of a first portion 256 and a second portion 258. Each portion 256, 258 may be configured to hold utensils as described above, but the first portion 256 may have a depth greater than that of the second portion 258. While two portions are illustrated, more than two portions each with varying depths, may be included. Having a utensil portion with varying depths may allow for the second rack 124 to hold items of varying heights without abutting or obstructing the tray 126 from below.

Figure 7B:
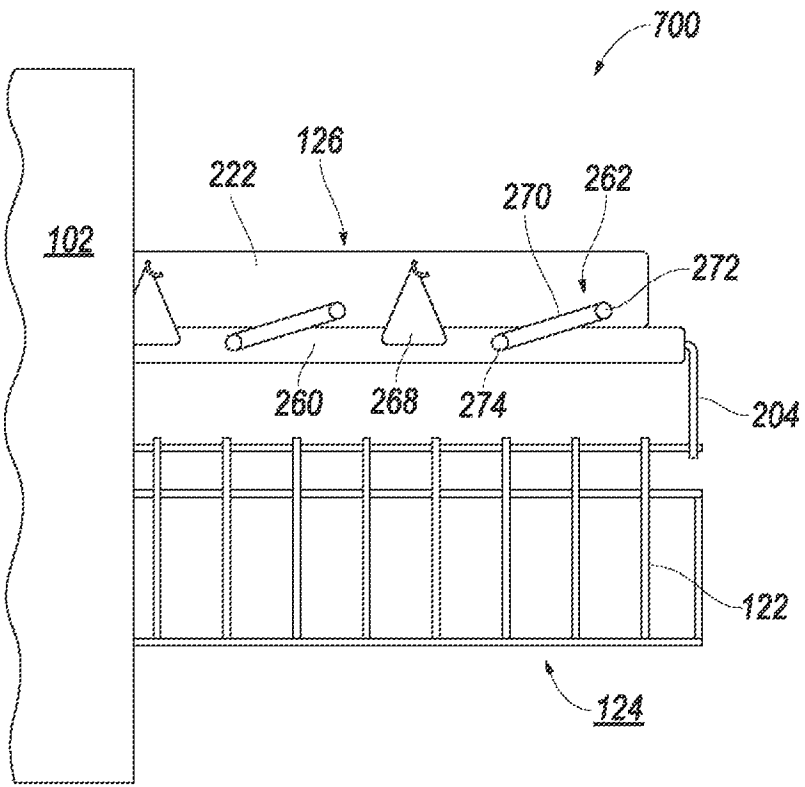
FIG. 7B illustrates a side view of the example rack assembly of FIG. 7A in a resting position.
Figure 7A:
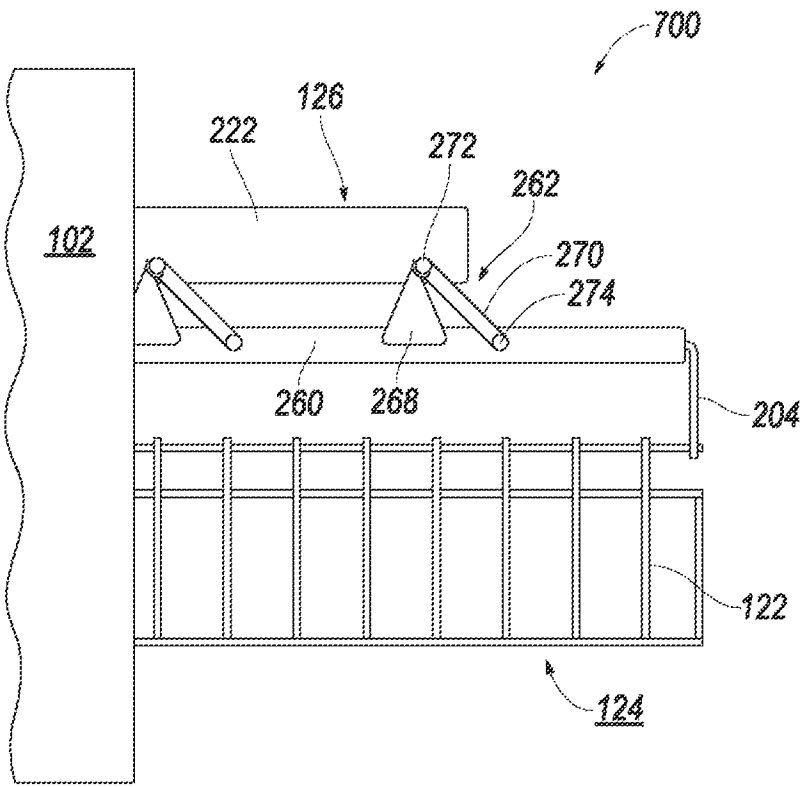
FIG. 7A illustrates a side view of another example rack assembly in an elevated position.

FIGS. 7A and 7B illustrate side views of another example rack assembly 500. This rack assembly 500 includes the tray 126 arranged above the second rack 124. A support platform 260 may extend across the horizontal rods 202 (not visible in FIGS. 7A and 7B) at the sides of the second rack 124. Similar to the configurations above, the horizontal rods 202 and the vertical rods 204 may support the tray 126 arranged above the second rack 124. The platform 260 may be a solid structure resting on and secured to the horizontal rods 202. The platform 260 may be made of a plastic material.

At least one hinged support 262 may be arranged between the tray 126 and the second rack 124 at the platform 260. The hinged supports 262 may connect the tray 126 to the second tray 124 and allow for movement of the tray 126 relative to the second tray 124 between a first elevated position and a second resting position. An example of the tray 126 in the elevated position is illustrated in FIG. 7A. In this example, the tray 126 is arranged above the platforms 260, allowing for a greater clearance area at the second rack 124. That is, when the tray 126 is in the elevated position, taller items may be placed in the second rack 124. Additionally, the tray 126 may be elevated to allow easier access to the second rack 124 during loading.

FIG. 7B illustrates the tray 126 in the resting position along the platform 260. In this position, the tray may rest on the platform 260. While the raised platform 260 allows for access to the second rack 124, the clearance or height relative to the second rack 124 is less than that if the tray 126 were in the elevated position. In the resting position, however, the tray 126 may have a greater clearance height from the top of the dishwasher tub 104. Thus, the hinged supports 262 allow for a flexible and selectable configuration of the tray 126 and second rack 124.

The hinged support 262 may include a stop 268 attached to the engagement area 222 of the tray 126. The stop 268 may be in the form of a fulcrum and may be fixed to the engagement area 222 at its apex. The hinged support 262 may also include at least one shaft 270 extending between the tray 126 at a tray attachment point 272 and the platform 260 at a platform attachment point 274. The shaft 270 may be radially fixed to each of the tray 126 and the platform 260 so that the shaft 270 may be radially movable at each fixed point. The tray 126 may hinge between the elevated position and the resting position via the shaft 270.

In the resting position, as illustrated in FIG. 7B, the tray 126 may be arranged in a more forward position where the shaft 270 pivots forward relative to the platform 260. In the elevated position, as illustrated in 5A, the shaft 270 may pivot backward and hold the tray 126 above the platform 260. The tray attachment point 272 and the fulcrum apex may abut each other when the tray 126 is in the elevated position. The stop 268 may hold the shaft 270 in a fixed position and prevent the shaft 270 from continuing to rotate at the tray attachment point 272. That is, the shaft 270 my rest against the stop 268, securing the tray 126 in an elevated position.

As shown in the figures, a plurality of supports 262 may be arranged along the tray 126 and platform 260 of the second rack 124. In practice, at least two hinged supports 262 may be included on each platform 260 of the second rack 124; a support 262 being arranged at each end of the platform 260.

Accordingly, a dishwasher assembly having racks, with a tray arranged above the rack, but being retained within the dishwasher tub during non-use is described herein. By allowing the tray to be retained, usability and access to the rack is increased. Further, the tray support 136 removes the need for an additional support rail to be arranged on the tub 104, thus decreasing costs and manufacturing time for the dishwasher.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An automatic dishwashing device, comprising:

a tub defining a hollow dishwashing cavity having a back, top, bottom, and two sides and is accessible via an access opening at a front of the cavity;

a rack slidably disposed within the tub and moveable in a longitudinal direction between a stored position within the tub to an extended position where the rack extends outside of the tub, the rack including a pair of support rods extending in the longitudinal direction, one on each side of the rack; and a tray slidably engaged with the support rods via a pair of engagement areas, one on each side of the tray, for sliding movement in the longitudinal direction, wherein the tray is configured to selectively remain partially within the tub when the rack is in the extended position or extend outside the tub when the rack is in the extended position, wherein the engagement area maintains the tray in a fixed vertical position both when the tray remains within the tub when the rack is in the extended position and when extending outside the tub when the rack is in the extended position, the tray including a utensil area configured to receive utensils and wherein the engagement areas each include an extender extending from a front of the tray and along the respective support rods via a guide recess defined by the extender, the extender configured to receive the respective support rod in a sliding engagement to support the tray when the tray remains within the tub and the rack is in an extended position such that the tray is supported by the rack.

2. The automatic dishwashing device of claim 1, wherein the engagement areas are configured to provide a friction fit with the respective support rod and configured to slide along the support rod in response to receiving a force above a threshold of the friction fit.

3. The automatic dishwashing device of claim 1, further comprising a lever arranged within the tub and configured to selectively engage the tray between fixed/unfixed positions, wherein in the fixed position the tray is configured to move with the rack and in the unfixed position the tray is configured to be substantially retained within the tub when the rack is in the extended position.

4. The automatic dishwashing device of claim 1, wherein the utensil area of the tray includes a plurality of projection rows in the longitudinal direction.

5. The automatic dishwashing device of claim 4, wherein the projection rows include perpendicular projection rows arranged in the longitudinal direction.

6. The automatic dishwashing device of claim 5, wherein each of the projection rows are distinct and spaced from the other projection rows and configured to receive utensils.

7. The automatic dishwashing device of claim 1, further comprising a retention mechanism arranged on each side of the tub adjacent to the tray to engage and maintain the tray within the tub while the rack is in the extended position.

8. The automatic dishwashing device of claim 1, wherein the tray includes a first portion and a second portion distinct from the first portion, wherein the first portion has a greater depth than the second portion.

9. An automatic dishwashing device, comprising:

a frame having a front, back, top, bottom and two sides;

a tub arranged within the frame and defining a hollow dishwashing cavity accessible via an access opening at the front of the frame;

a rack slidably disposed within the tub and longitudinally extendable from a stored position within the tub to an extended position outside of the tub; and at least one tray including a utensil area and slidably fixed above the rack on a pair of opposite and parallel support rods extending from a front to a back of the rack, wherein the tray is configured to selectively remain partially within the tub when the rack is in the extended position or extend outside the tub when the rack is in the extended position, the tray including an engagement area adjacent the utensil area and an engagement extender extending from the engagement area from a front of the tray on each side of the tray and defining a guide recess to slidably engage the respective support rod, wherein the engagement area is configured to rest on the respective support rod and the engagement extender is configured to selectively receive a portion of the respective support rod to support the tray when the tray remains within the tub and the rack is in the extended position.

10. The automatic dishwashing device of claim 9, wherein the tray includes a first portion and a second portion distinct from the first portion, wherein the first portion has a greater depth than the second portion.

11. The automatic dishwashing device of claim 10, wherein each of the first portion and the second portion include a plurality of projection rows in each of the longitudinal and perpendicular directions.

12. The automatic dishwashing device of claim 9, wherein the tray is configured to selectively engage and slide along the support rods in a longitudinal direction.

* * * * *